US008836595B2

(12) United States Patent
Hanazawa et al.

(10) Patent No.: US 8,836,595 B2
(45) Date of Patent: Sep. 16, 2014

(54) ANTENNA DEVICE

(75) Inventors: Masahiro Hanazawa, Aichi-gun (JP); Nobuhiro Ide, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 322 days.

(21) Appl. No.: 13/262,699

(22) PCT Filed: Apr. 1, 2010

(86) PCT No.: PCT/IB2010/000741
§ 371 (c)(1),
(2), (4) Date: Oct. 13, 2011

(87) PCT Pub. No.: WO2010/113024
PCT Pub. Date: Oct. 7, 2010

(65) Prior Publication Data

US 2012/0026060 A1 Feb. 2, 2012

(30) Foreign Application Priority Data

Apr. 3, 2009 (JP) ..... 2009-090992

(51) Int. Cl.

| | |
|---|---|
| ***H01Q 11/06*** | (2006.01) |
| ***H01Q 11/02*** | (2006.01) |
| ***H01Q 11/12*** | (2006.01) |
| ***H01Q 21/28*** | (2006.01) |
| ***H01Q 7/00*** | (2006.01) |
| ***H01Q 1/22*** | (2006.01) |
| ***H01Q 1/32*** | (2006.01) |
| ***H01Q 21/29*** | (2006.01) |
| ***H01Q 3/24*** | (2006.01) |

(52) U.S. Cl.

CPC ..... *H01Q 7/00* (2013.01); *H01Q 21/28* (2013.01); *H01Q 1/2241* (2013.01); *H01Q 1/32* (2013.01); *H01Q 21/29* (2013.01); *H01Q 3/24* (2013.01)

USPC ..... 343/734; 343/733; 343/731; 343/742; 343/744

(58) Field of Classification Search

USPC ..... 343/739, 741, 742, 744, 752, 803, 844, 343/855, 867, 893, 731, 732, 733, 734

See application file for complete search history.

(56) References Cited

U.S. PATENT DOCUMENTS 2,537,191 A * 1/1951 Moore ..... 343/742
2,787,788 A * 4/1957 Clough ..... 343/867

(Continued)

FOREIGN PATENT DOCUMENTS

CN 2166528 Y 5/1994
CN 101030319 A 9/2007

(Continued)

OTHER PUBLICATIONS

Chinese Office Action issued in Application No. 201080015153.3; Dated Jul. 2, 2013 (With Translation).

(Continued)

*Primary Examiner* — Hoang V Nguyen
*Assistant Examiner* — Patrick Holecek
(74) *Attorney, Agent, or Firm* — Oliff PLC

(57) ABSTRACT

An antenna device that radiates or receives a radio wave includes: a first wire line; a second wire line that is parallel to the first wire line; a power feeding/receiving point that is provided at proximal portions of the first wire line and second wire line; and a terminal resistance that is provided at distal end portions of the first wire line and second wire line.

15 Claims, 10 Drawing Sheets

(56) References Cited

U.S. PATENT DOCUMENTS

| | | | | | |
|---|---|---|---|---|---|
| 3,329,954 | A * | 7/1967 | Travers | 342/445 |
| 3,605,097 | A * | 9/1971 | Hadik-Barkoczy | 343/739 |
| 4,115,780 | A * | 9/1978 | Goodman | 343/739 |
| 4,785,303 | A * | 11/1988 | Clark et al. | 343/742 |
| 5,592,182 | A * | 1/1997 | Yao et al. | 343/742 |
| 5,654,724 | A * | 8/1997 | Chu | 343/742 |
| 6,154,177 | A | 11/2000 | Saito et al. | |
| 6,211,846 | B1 * | 4/2001 | Gouin | 343/891 |
| 7,446,714 | B2 * | 11/2008 | Biddulph | 343/702 |
| 7,956,815 | B2 * | 6/2011 | Ohira et al. | 343/730 |
| 2005/0172707 | A1 | 8/2005 | Kanatani et al. | |
| 2007/0182634 | A1 * | 8/2007 | Yamamoto et al. | 343/700 MS |

FOREIGN PATENT DOCUMENTS

| | | |
|---|---|---|
| EP | 1 526 467 A1 | 4/2005 |
| GB | 1 507 674 | 4/1978 |
| JP | U-04-029250 | 3/1992 |
| JP | A-11-088246 | 3/1999 |
| JP | A-2001-024431 | 1/2001 |
| JP | A-2003-298331 | 10/2003 |
| JP | A-2003-306017 | 10/2003 |
| JP | A-2005-162192 | 6/2005 |
| JP | A-2008-034982 | 2/2008 |
| WO | WO 2005/943676 A1 | 5/2005 |

OTHER PUBLICATIONS

Takehiko Tsukiji, "Fundamental of Electric Wave and Antenna Engineering," *Sogo Denshi Shuppansha*, 1st Edition, Section 10, Part 3 "Transmission Line Antenna," etc., Mar. 2002.

Japanese Office Action issued in Application No. 2009-090992; Dated Mar. 29, 2011 (With Translation).

Written Opinion of the International Searching Authority issued in Application No. PCT/IB2010/000741; Dated Jul. 27, 2010.

International Search Report issued in Application No. PCT/IB2010/000741; Dated Jul. 27, 2010.

* cited by examiner

F/B (FRONT-BACK) RATIO (XY-PLANE)

ANALYZING FREQUENCY : 315 MHz
(WAVELENGTH: ABOUT 95 cm)

RELATIONSHIP BETWEEN POWER RECEIVING POINT AND DIRECTIVITY (XY-PLANE)

RELATIONSHIP BETWEEN POWER RECEIVING POINT AND DIRECTIVITY (XY-PLANE)

RELATIONSHIP BETWEEN POWER RECEIVING POINT AND DIRECTIVITY (XY-PLANE)

RELATIONSHIP BETWEEN POWER RECEIVING POINT AND DIRECTIVITY (XY-PLANE)

RELATIONSHIP BETWEEN POWER RECEIVING POINT AND DIRECTIVITY (XY-PLANE)

ANTENNA DEVICE

BACKGROUND OF THE INVENTION

1. Field of the Invention

The invention relates to an antenna device that radiates or receives radio waves. Specifically, the invention relates to an antenna device that may be applied to a tire pressure detecting device of an automobile.

2. Description of the Related Art

In an existing art, an antenna device described in Japanese Patent Application Publication No. 2001-24431 (JP-A-2001-24431) is known. The antenna device is formed of a feeding antenna disposed upright at the center of a grounded conductor and a plurality of parasitic antennas that are disposed upright around the feeding antenna and that have variably controllable reactances. In this antenna device, the reactances of the surrounding parasitic antennas are electrically varied to thereby control the directivity of the antenna device.

Japanese Patent Application Publication No. 11-88246 (JP-A-11-88246) describes an antenna for a small mobile receiver. In the antenna, loop antennas are provided on different sides of a rectangular parallelepiped box, and then radio waves to be received by the respective loop antennas are switched to receive radio waves to thereby improve the sensitivity of the antenna.

Japanese Patent Application Publication No. 2003-298331 (JP-A-2003-298331) describes an antenna device for a wireless mouse. In the antenna device, loop antennas are arranged respectively on two sides perpendicular to each other, and a directivity of the antenna device is switched to the directivity corresponds to the selected loop antenna to implement resistance to noise.

Japanese Patent Application Publication No. 2005-162192 (JP-A-2005-162192) describes a tire pressure detecting device.

However, in the antenna device described in JP-A-2001-24431, the length of each antenna disposed upright on the grounded conductor is $\lambda/4$, and the interval between the central feeding antenna and each of the surrounding parasitic antennas is $\lambda/4$, so the antenna device at least requires a volume of a diameter of $\lambda/2$ and a height of $\lambda/4$. In JP-A-11-88246 and JP-A-2003-298331, the loop antennas each having a length of one wavelength are arranged on the sides perpendicular to each other, so the size of the antenna device increases. In the case of a system that detects a tire pressure of an automobile, a radio wave having a frequency of 315 MHz is used. In this case, the size of an antenna according to the above technique is about 50 cm, so it is difficult to use the antenna for the tire pressure detecting system. In the tire pressure detecting system, an antenna device that receives tire pressure data transmitted from four wheels is provided at a ceiling in the cabin of the automobile, so it is necessary to reduce the size of the antenna device as much as possible.

SUMMARY OF THE INVENTION

The invention provides an antenna device that is able to accurately receive radio waves coming from a specific direction or accurately radiate radio waves toward a specific direction.

A first aspect of the invention provides an antenna device that radiates or receives a radio wave. The antenna device includes: a first wire line; a second wire line that is parallel to the first wire line; a power feeding/receiving point that is provided at proximal portions of the first wire line and second wire line; and a terminal resistance that is provided at distal end portions of the first wire line and second wire line.

A second aspect of the invention provides an antenna device that radiates or receives a radio wave. The antenna device includes: four wire antennas, wherein each of the wire antennas includes: a first wire line; a second wire line that is parallel to the first wire line; a power feeding/receiving point that is provided at proximal portions of the first wire line and second wire line; and a terminal resistance that is provided at distal end portions of the first wire line and second wire line, wherein a first antenna set formed of the pair of facing wire antennas is arranged so that orientation vectors of the respective wire antennas directed from the power feeding/receiving points to the terminal resistances are antiparallel to each other, a second antenna set formed of the other pair of facing wire antennas is arranged so that the orientation vectors of the respective wire antennas are antiparallel to each other, and the first antenna set and the second antenna set are arranged so that the orientation vector of one of the wire antennas of the first antenna set is not parallel to the orientation vector of one of the wire antennas of the second antenna set.

In the first aspect and the second aspect, the antenna device may be a radiation antenna device that radiates radio waves or a receiving antenna device that receives radio waves. The principles of operation are similar between the radiation antenna device and the receiving antenna device. Therefore, an example that the antenna device is configured as the radiation antenna device will be described. The antenna device according to the first aspect is formed of a single wire antenna that includes a first wire line and a second wire line. The antenna device according to the second aspect is formed of four wire antennas.

In the first aspect of the invention, power is fed in one direction from the power feeding point toward the terminal resistance, an electromagnetic field that has reached the impedance-matched terminal resistance is absorbed by the terminal resistance and is not reflected. That is, in this wire antenna, a traveling wave propagates at the velocity of light from the power feeding point through the first wire line and the second wire line toward the terminal resistance, and no standing wave occurs. As a result, in one wire antenna, radio waves are radiated at all the micro portions in the path toward the terminal resistance at an initial phase, that is, the phase of that location at that time. The initial phase of each radiated radio wave is advanced as the location approaches the terminal resistance. In addition, radio waves radiated at the initial phases of the respective micro portions of the wire antenna propagate through a space at the velocity of light and then delay, and then form an equiphase wave surface with radio waves that are radiated the delayed period of time before and of which the initial phases are delayed. Thus, the equiphase wave surface of radio waves is a surface vertical to the wire antenna, and the traveling direction of the radiated radio waves coincides with the longitudinal direction of the wire antenna from the terminal resistance toward the power feeding point. That is, the wire antenna exhibits the directivity in the longitudinal direction of the wire antenna from the terminal resistance toward the power feeding point. On the other hand, a radio wave radiated from the power feeding point toward the terminal resistance does not form an equiphase wave surface. Thus, it is possible to form an antenna that has a high F/B (front radiation/back radiation) ratio. Similarly, in the case of the receiving antenna device, a wave traveling in the longitudinal direction of the wire antenna from the power receiving point toward the terminal resistance may be received at an equiphase wave surface. Thus, the receiving antenna device may have a directivity in the longitudinal direction of the wire antenna from the power receiving point toward the terminal resistance and have a high FIB ratio.

When the impedance of the terminal resistance is matched with the impedance of the wire antenna, as described above, the radiation antenna device has a directivity in the longitudinal direction of the wire antenna from the terminal resistance toward the power feeding paint and has a high FIB ratio. When the impedance of the terminal resistance is not matched with the impedance of the wire antenna, a standing wave occurs in the wire antenna and, therefore, the directivity deviates from the longitudinal direction of the wire antenna.

In this way, the antenna device according to the first aspect may be configured as a radiation antenna device and a receiving antenna device that has a high F/B ratio in one direction. In the second aspect, the four antennas having the above characteristics are arranged in four directions, so the antenna device is able to selectively radiate a radio wave in one of four directions or selectively receive a radio wave in one of four directions.

In the first aspect and the second aspect, it is only necessary that the antenna is able to form a traveling wave, so it is not necessary to set a wavelength condition, such as $\lambda/2$, determined on the basis of a frequency of a radio wave used, for the length of the antenna. The length of the first wire line may be smaller than or equal to a wavelength of a radio wave used and larger than or equal to one-tenth of the wavelength of the radio wave used. The length of the first wire line is smaller than or equal to the wavelength of a radio wave used, so the size of the antenna device may be set to have appropriate dimensions depending on the frequency of a radio wave used. In addition, the length of the first wire line is set to one-tenth or above of a radio wave used, so it is possible to ensure radiation efficiency or receiving efficiency. In addition, the interval between the first wire line and second wire line of the antenna device is desirably smaller than or equal to half of the length of the first wire line and larger than or equal to one-third of the length of the first wire line. When the interval is set to be smaller than or equal to half of the length of the first wire line, it is possible to suppress an increase in radiation from the second wire line. When the interval is set to be larger than or equal to one-third of the length of the first wire line, it is possible to prevent the first wire lines of the respective wire antennas from being coupled to each other when the antenna device is formed of four wire antennas.

In the second aspect, an angle made between the orientation vector of one of the wire antennas of the first antenna set and the orientation vector of one of the wire antennas of the second antenna set may be larger than or equal to 45 degrees and smaller than or equal to 135 degrees. The angle may be set on the basis of a radiation direction of a radio wave and an incoming direction of a radio wave to be received. In addition, the angle may be 90 degrees. When the antenna device is configured as a receiving antenna device, the receiving level of the second antenna set is minimal when the radio waves are being received by the first antenna set at the maximum receiving level, so it is possible to improve the accuracy of specifying the incoming direction. In addition, when the incoming direction of a radio wave that comes in an arbitrary direction is specified as well, the angle may be 90 degrees. When the angle is 90 degrees, two components perpendicular to a vector in the incoming direction may be obtained. When the antenna device is configured as a radiation antenna device, controllability of the direction of a radiated radio wave is improved. In the receiving antenna device that includes the first antenna set and the second antenna set, when the angle is larger than or equal to 45 degrees and smaller than or equal to 135 degrees, the receiving level of the second antenna set may be reduced to a half level for a radio wave coming in the longitudinal direction of the first antenna set, so the incoming direction may be specified, and the accuracy of specifying the incoming direction of a radio wave that comes in an arbitrary direction is high.

The four wire antennas may be arranged on the same plane. By so doing, the size of the antenna device in the vertical direction to the plane may be reduced. In contrast, the first antenna set and the second antenna set may be arranged on top of each other. By arranging the first antenna set and the second antenna set on top of each other, it is possible to reduce a footprint on the plane.

The four wire antennas may be arranged so as to form any one of a square, a rhombus, a rectangle and a parallelogram. This arrangement may be applied to when the four wire antennas are arranged on the plane or when the four wire antennas are arranged on top of each other. In the case of a square or a rhombus, it is possible to equalize the maximum receiving levels or maximum radiation power levels in the four directions. In the case of a square or a rectangle, the orientation vector of one of the wire antennas of the first antenna set may be perpendicular to the orientation vector of one of the wire antennas of the second antenna set, so the accuracy of detecting the incoming direction may be improved, and controllability of the radiation direction may be improved.

In addition, the four wire antennas may be radially arranged. In addition, each second wire line may be formed of a mirror image of the corresponding first wire line, formed by a planar conductor. That is, each wire antenna may be formed of the planar conductor and the first wire line that is arranged at an interval from the planar conductor (the planar conductor and the first wire line may be parallel to each other). By so doing, it is possible to simplify the structure of the antenna device. In addition, by using the planar conductor as a reflecting surface for a radio wave, the receiving level for a radio wave may be improved, and, furthermore, the power density of a radio wave radiated in a specific direction may be improved. In addition, a reflecting plate shared by the wire antennas may be provided for the four wire antennas so as to reflect an incoming radio wave. By so doing, the receiving level for radio waves may be improved, and, furthermore, the power density of a radiation radio wave in a specific direction may be improved. In addition, the interval between each second wire line and the reflecting plate is desirably larger than or equal to one-twentieth of a wavelength of a radio wave used and smaller than or equal to one-tenth of the wavelength of the radio wave used. When the interval is set to be larger than or equal to one-twentieth of the wavelength of the radio wave used, it is possible to suppress influence on the antenna characteristics. When the interval is set to be larger than or equal to one-tenth of the wavelength of the radio wave used, it is possible to suppress an increase in size of the metal plate.

In the first aspect, the terminal resistance is provided at the distal end portion of the first wire line of the wire antenna that includes the first wire line and the second wire line, and is then connected to the second wire line. Thus, when the antenna device is configured as the radiation antenna device, it is possible to obtain the directivity, of which the F/B ratio is high, in the longitudinal direction of the wire antenna from the terminal resistance toward the power feeding point. In addition, when the antenna device is configured as the receiving antenna device, it is possible to obtain the directivity, of which the F/B ratio is high, in the longitudinal direction of the wire antenna from the power receiving point toward the terminal resistance.

In the second aspect, when the antenna device is configured as the radiation antenna device, the first antenna set formed of the pair of parallel wire antennas of which power feeding directions are opposite and the second antenna set having a similar configuration are arranged so as not to be parallel to each other, so it is possible to accurately control the radiation direction of a radio wave. In addition, when the antenna device is configured as the receiving antenna device, the first antenna set formed of the pair of wire antennas of which the maximum power receiving directions are opposite and the second antenna set having a similar configuration are arranged so as not to be parallel to each other, so it is possible to accurately detect the incoming direction of a radio wave.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Hereinafter, a specific embodiment according to the aspect of the invention will be described with reference to the accompanying drawings; however, the aspect of the invention is not limited to the embodiment.

Figure 1:
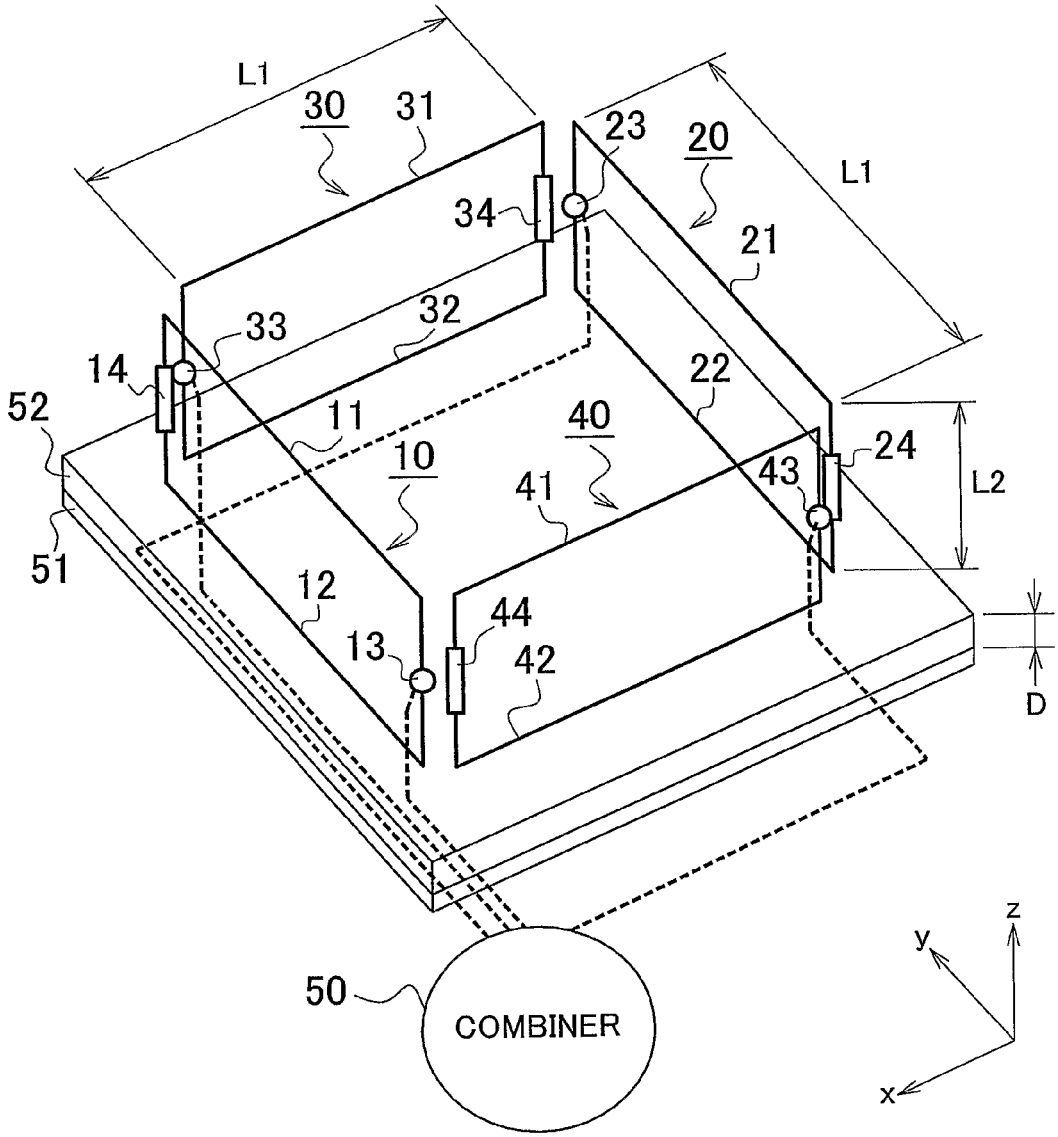
FIG. 1 is a configuration diagram of an antenna device according to a first embodiment.

FIG. 1 is a configuration diagram of a receiving antenna device according to a first embodiment. A wire antenna 10 has a rectangular shape. The wire antenna 10 is formed of a first wire line 11, a second wire line 12, a power receiving point 13 and a terminal resistance 14. The power receiving point 13 is provided at the proximal portions of these wire lines. The terminal resistance 14 is provided at the distal end portion of the antenna and at a connecting point between the first wire line 11 and the second wire line 12. The interval between the first wire line 11 and the second wire line 12 is L2. A wire antenna 20 is provided parallel to the wire antenna 10. The wire antenna 20, as well as the wire antenna 10, has a rectangular shape. The wire antenna 20 is formed of a first wire line 21, a second wire line 22, a power receiving point 23 and a terminal resistance 24. The power receiving point 23 is provided at the proximal portions of these wire lines. The terminal resistance 24 is provided at the distal end portion of the antenna and at a connecting point between the first wire line 21 and the second wire line 22. The interval between the first wire line 21 and the second wire line 22 is L2. The wire antenna 10 and the wire antenna 20 are provided at the distance L1 from each other and parallel to each other. An orientation vector directed from the power receiving point 13 of the wire antenna 10 to the terminal resistance 14 of the wire antenna 10 and an orientation vector directed from the power receiving point 23 of the wire antenna 20 to the terminal resistance 24 of the wire antenna 20 are antiparallel to each other. These wire antenna 10 and wire antenna 20 constitute a first antenna set.

A wire antenna 30 has a rectangular shape. The wire antenna 30 is formed of a first wire line 31, a second wire line 32, a power receiving point 33 and a terminal resistance 34. The power receiving point 33 is provided at the proximal portions of these wire lines. The terminal resistance 34 is provided at the distal end portion of the antenna and at a connecting portion between the first wire line 31 and the second wire line 32. The interval between the first wire line 31 and the second wire line 32 is L2. A wire antenna 40 is provided parallel to the wire antenna 30. The wire antenna 40, as well as the wire antenna 30, has a rectangular shape. The wire antenna 20 is formed of a first wire line 41, a second wire line 42, a power receiving point 43 and a terminal resistance 44. The power receiving point 43 is provided at the proximal portions of these wire lines. The terminal resistance 44 is provided at the distal end portion of the antenna and at a connecting portion between the first wire line 41 and the second wire line 42. The interval between the first wire line 41 and the second wire line 42 is L2. The wire antenna 30 and the wire antenna 40 are provided at the distance L1 from each other and parallel to each other. An orientation vector directed from the power receiving point 33 of the wire antenna 30 to the terminal resistance 34 of the wire antenna 30 and an orientation vector directed from the power receiving point 43 of the wire antenna 40 to the terminal resistance 44 of the wire antenna 40 are antiparallel to each other. These wire antenna 30 and wire antenna 40 constitute a second antenna set.

These four wire antennas 10, 20, 30 and 40 have heights in the z-axis direction and are arranged on the same plane (xy-plane). In addition, the first antenna set formed of the wire antennas 10 and 20 is arranged in the y direction, and the second antenna set formed of the wire antennas 30 arid 40 is arranged in the x direction. That is, the longitudinal direction of the first antenna set is perpendicular to the longitudinal direction of the second antenna set. Then, the power receiving points 13, 23, 33 and 43 are connected to a combiner 50. The combiner 50 combines radio waves received by the respective wire antennas or selects one of the wire antennas to output only radio waves received by the one of the wire antennas. Note that each power receiving point is connected to a coaxial cable via a balun. Owing to the function of each balun, the first wire lines 11, 21, 31 and 41 and the second wire lines 12, 22, 32 and 42 are excited in a mode in which electric current flows in the same direction.

Figure 2:
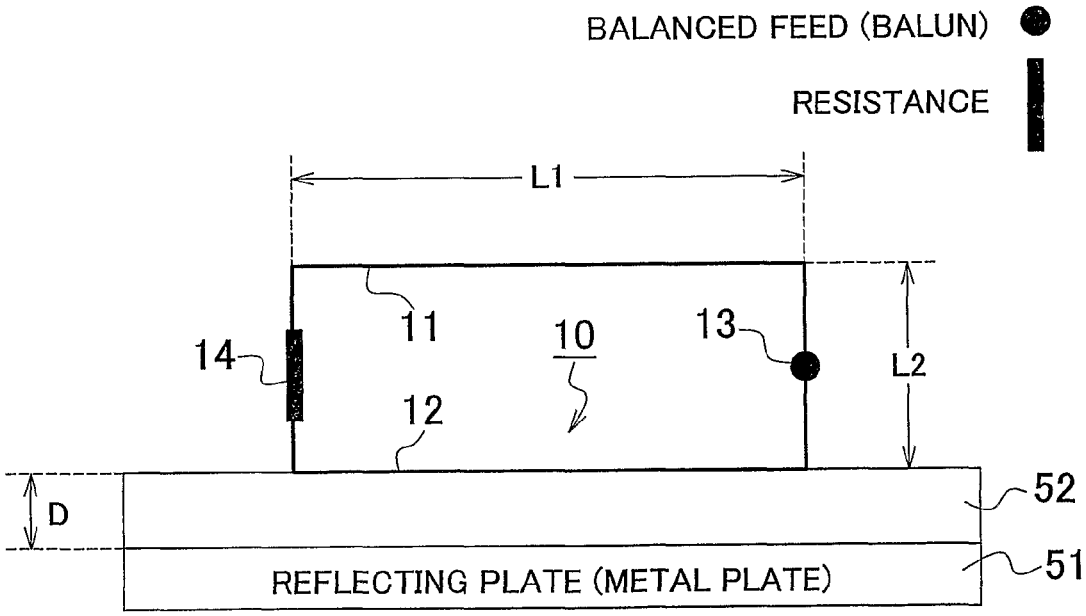
FIG. 2 is a configuration diagram of one wire antenna.

Then, these four wire antennas 10, 20, 30 and 40 are placed on a dielectric plate 52 having a thickness D. A reflecting plate 51 is bonded to the rear surface of the dielectric plate 52. The reflecting plate 51 is formed of a metal plate. The configuration of one wire antenna 10 is shown in FIG. 2. The reflecting plate 51 reflects incoming radio waves to make it possible to improve the level of a receiving signal. When each wire antenna is configured as a radiation antenna, radio waves radiated in an opposite direction are reflected by the reflecting plate 51 to thereby make it possible to improve the power density of radiated radio waves. As shown in FIG. 4B, in the present embodiment, L1 is 75 mm, L2 is 30 mm and D is 10 mm.

Figure 3:
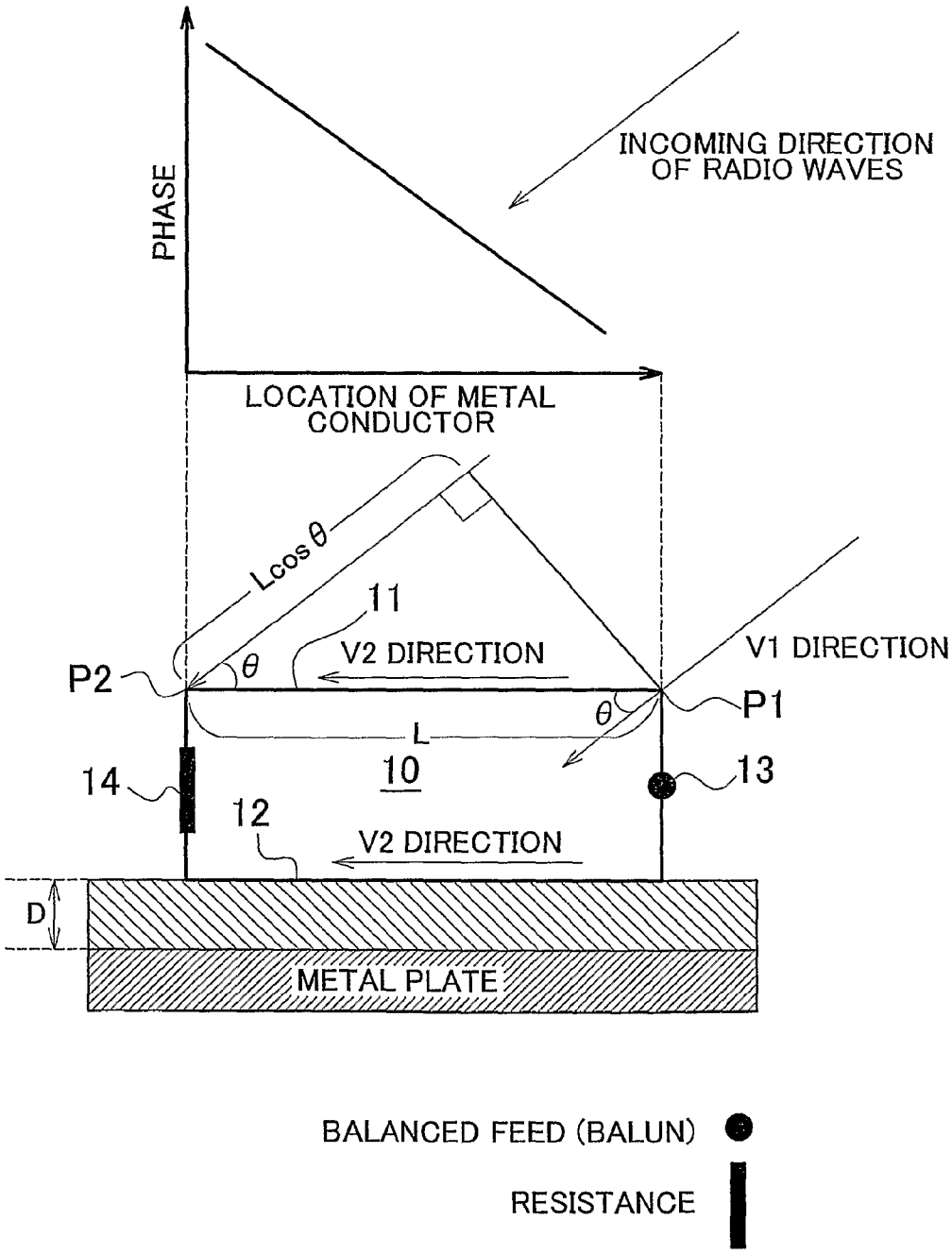
FIG. 3 is a view that illustrates the principles of directivity of one wire antenna.

Next, the principles of operation will be described. The operation related to the one wire antenna 10 is as follows. As shown in FIG. 3, in the first wire line 11 and the second wire line 12, a direction in which received radio waves propagate from the power receiving point 13 toward the terminal resistance 14 is defined to be positive. At this time, radio waves received at an end point P1 of the first wire line 11 adjacent to the power receiving point 13 may be expressed as follows.

$$\sin(\omega t+\alpha) \tag{1}$$

In addition, radio waves received at an end point P2 of the first wire line 12 adjacent to the terminal resistance 14 are expressed as follows.

$$\sin(\omega t+\alpha+\beta) \tag{2}$$

Here, $\alpha$ is a phase at the end point P1, and $\beta$ is a leading phase of received radio waves, which travel in the first wire line 11 from the end point P1 toward the end point P2, at the end point P2 with respect to the end point P1. That is, the phase at the end point P2 of radio waves that travel from the power receiving point 13 toward the terminal resistance 14 is advanced as compared with the phase at the end point P1.

The angle made between a traveling vector V1 of incoming radio waves and a traveling vector V2 of radio waves in the first wire line 11 is $\theta$. When the wire antenna 10 receives the plane wave of the traveling vector V1, radio waves reaching the end point P1 are expressed by the same mathematical expression as the mathematical expression (1) on the assumption that the phase of radio waves received at the end point P1 is equal to the phase of radio waves that travel in the first wire line 11.

The path difference between radio waves that reach the end point P1 and radio waves that reach the end point P2 is L $\cos(\theta)$. Thus, the time at which a plane wave received at the end point P1 is received at the end point P2 delays by $\Delta t$ expressed by the following mathematical expression with respect to the time at which the plane wave is received at the end point P1. In the mathematical expression, L is the length of the first wire line 11, and c is the velocity of light.

$$\Delta t=L\cos(\theta)/c \tag{3}$$

Thus, at time t, radio waves received at the end point P2 are a plane wave at time that is advanced by $\Delta t$ with respect to radio waves received at the end point P1. Radio waves received at the end point P2 at time t are expressed as follows.

$$\sin(\omega t+\alpha+\omega\Delta t) \tag{4}$$

When the phase of the radio waves is equal to the phase of radio waves that are expressed by the mathematical expression (2) and that propagate through the first wire line 11 toward the terminal resistance 14, radio waves of the same plane wave, received at the respective micro portions of the first wire line 11, overlap each other to become radio waves that propagate through the first wire line 11 toward the terminal resistance 14. Thus, the following mathematical expression holds.

$$\alpha+\beta=\alpha+\omega\Delta t,\ \beta=\omega\Delta t,\ \Delta t=\beta/\omega \tag{5}$$

From the mathematical expression (3), the following mathematical expression (6) is obtained.

$$L\cos(\theta)/c=\beta/\omega,\ \cos(\theta)=c\beta/(\omega L)=\lambda\beta/(2\pi L) \tag{6}$$

Because $\beta\lambda=2\pi L$, the following mathematical expression (7) is obtained.

$$\cos(\theta)=1 \tag{7}$$

That is, $\theta=0$. When the direction of the traveling vector V1 of incoming radio waves coincides with the direction of the traveling vector V2 of radio waves in the first wire line 11, the component of a signal that travels in the first wire line 11 is induced. Incoming radio waves from the other directions do not satisfy a phase matching condition as a deviation from the direction of the traveling vector V2 increases, so a traveling wave component decreases. The same applies to the second wire line 12.

In this way, the directivity of the wire antenna 10 for received radio waves is determined. This also applies to a radiation antenna.

Figure 4A:
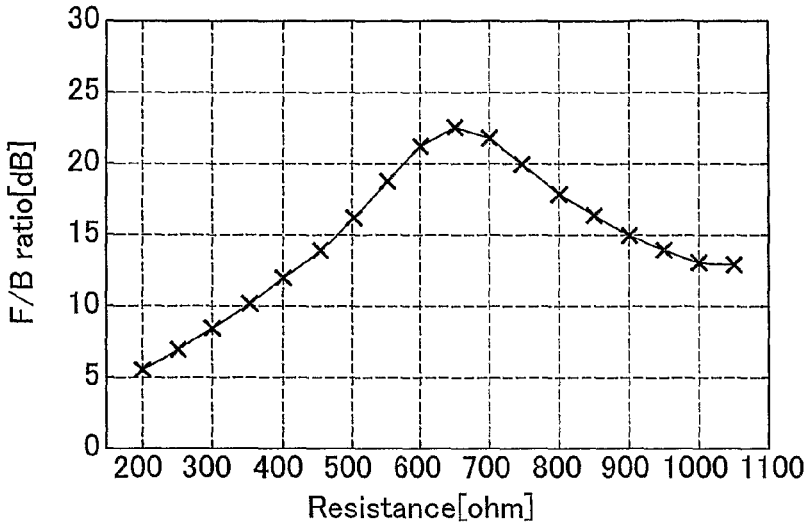
FIG. 4A is a characteristic graph that shows the F/B ratio (xy-plane) of one wire antenna.
Figure 4B:
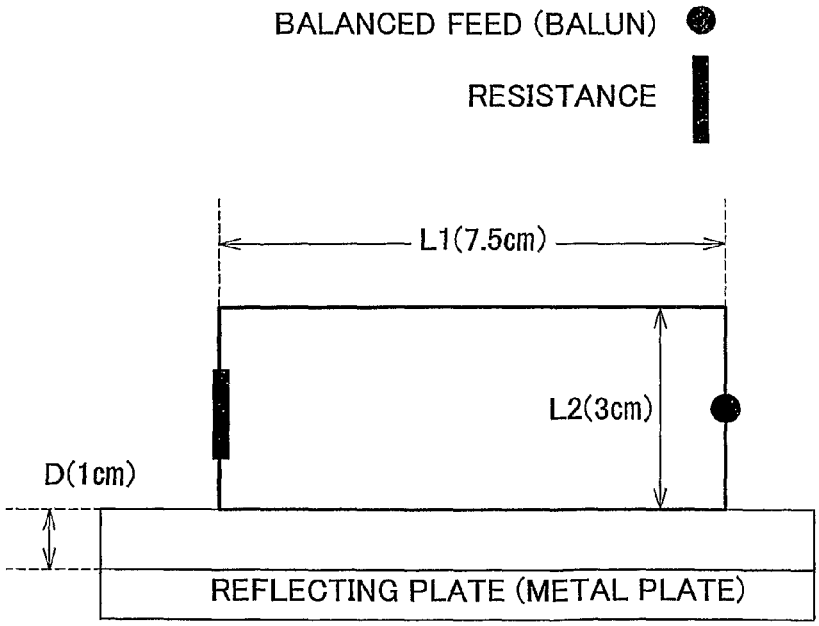
FIG. 4B is a specific configuration diagram of a wire antenna according to the first embodiment.

FIG. 4A is a characteristic graph of the relationship between the resistance of the terminal resistance 14 and the F/B ratio, measured for the wire antenna 10. It appears that, when the terminal resistance 14 is 650Ω, the obtained F/B ratio is 23 dB. The frequency of a radio wave used is 315 MHz. Note that the F/B ratio indicates the ratio of a received electric power F when the incoming direction of radio waves is the same as that of the traveling vector V2 of radio waves that propagate through the first wire line 11 to a received electric power B when the incoming direction of radio waves is opposite to the direction of the traveling vector V2.

Figure 5A:
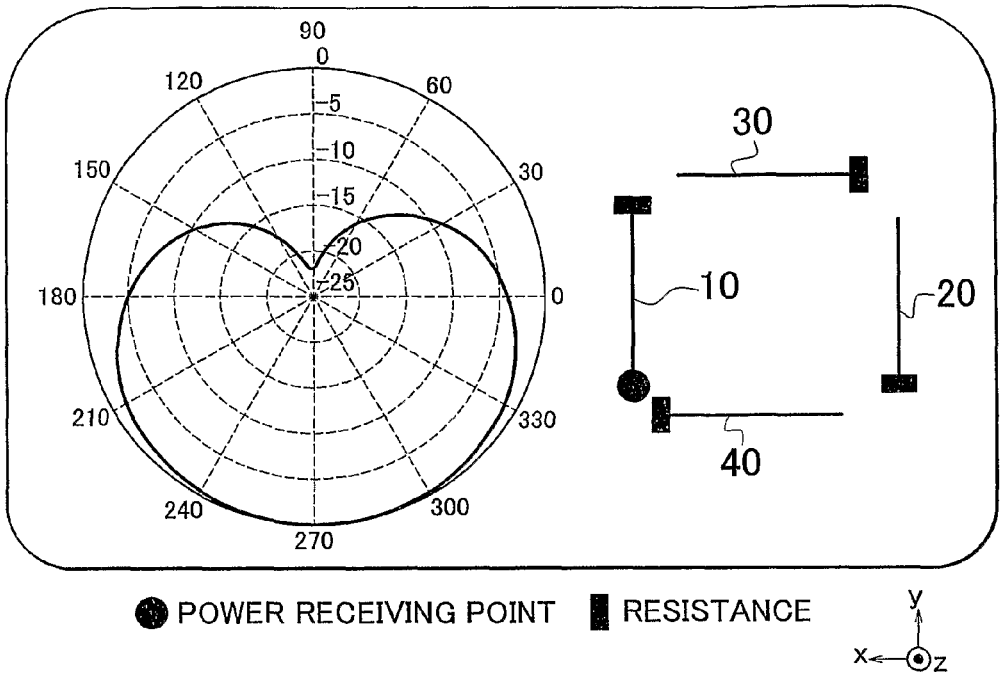
FIG. 5A to FIG. 5D are characteristic graphs that show directivities when respective wire antennas of the antenna device according to the first embodiment are selected.
Figure 5B:
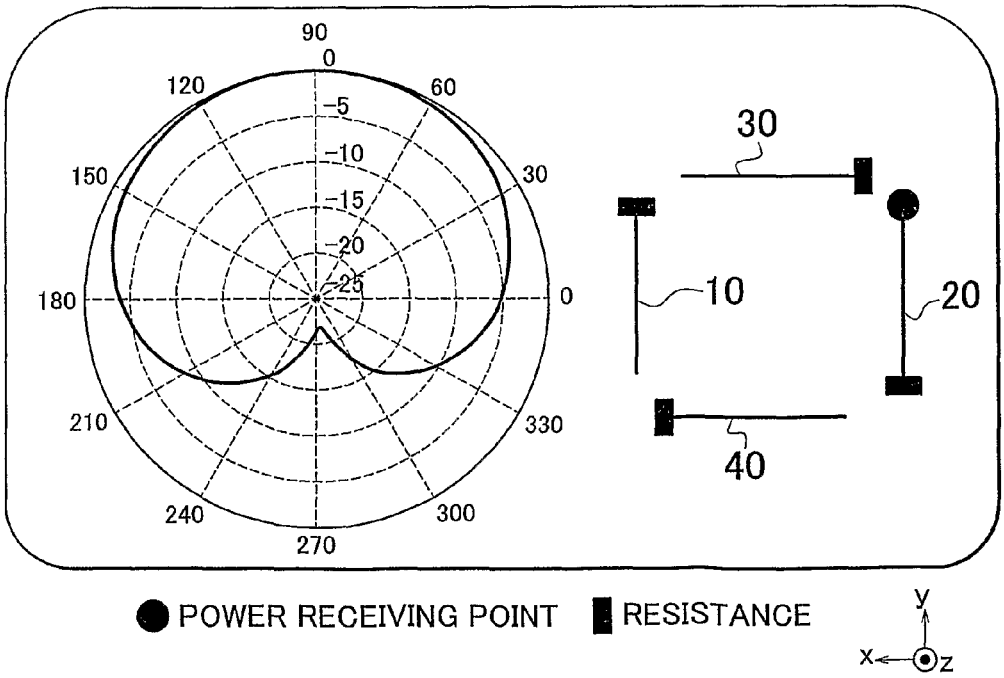
Figure 5C:
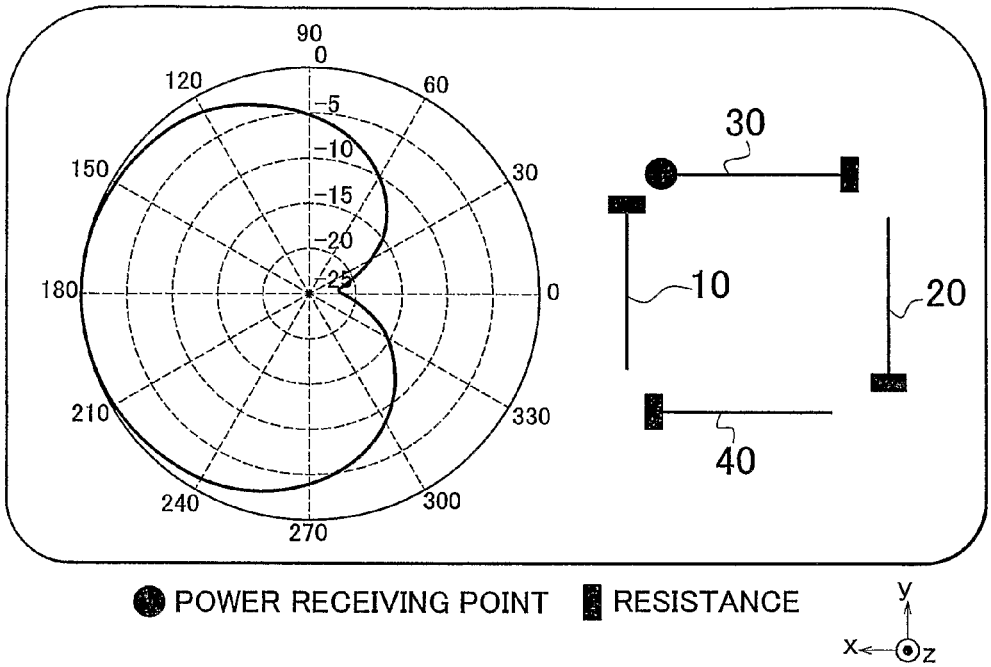
Figure 5D:
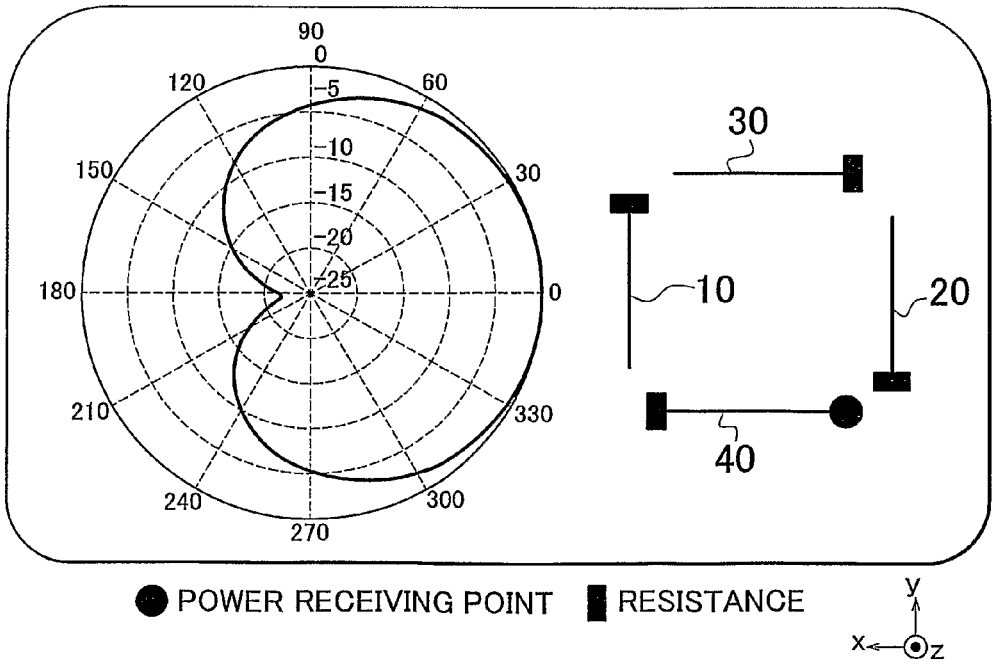

Next, FIG. 5A to FIG. 5D show the directional characteristics when the antenna device according to the embodiment receives radio waves with a selected one of the wire antennas 10, 20, 30 and 40 while all the terminal resistances are set to 700Ω and the frequency is set at 315 MHz. As shown in FIG. 5A, the wire antenna 10, of which the direction from the power receiving point to the terminal resistance is a positive y direction, exhibits the directivity in the positive y direction. As shown in FIG. 5B, the wire antenna 20, of which the direction from the power receiving point to the terminal resistance is a negative y direction, exhibits the directivity in the negative y direction. As shown in FIG. 5C, the wire antenna 30, of which the direction from the power receiving point to the terminal resistance is a negative x direction, exhibits the directivity in the negative x direction. As shown in FIG. 5D, the wire antenna 40, of which the direction from the power receiving point to the terminal resistance is a positive x direction, exhibits the directivity in the positive x direction. Because the respective wire antennas have the above directivities, the antenna device according to the first embodiment is able to accurately detect radio waves coming in the positive x, negative x, positive y and negative y directions. Thus, the antenna device may be suitably used for the system that detects tire pressures by receiving radio waves radiated from the sensors embedded in the tires.

Figure 6:
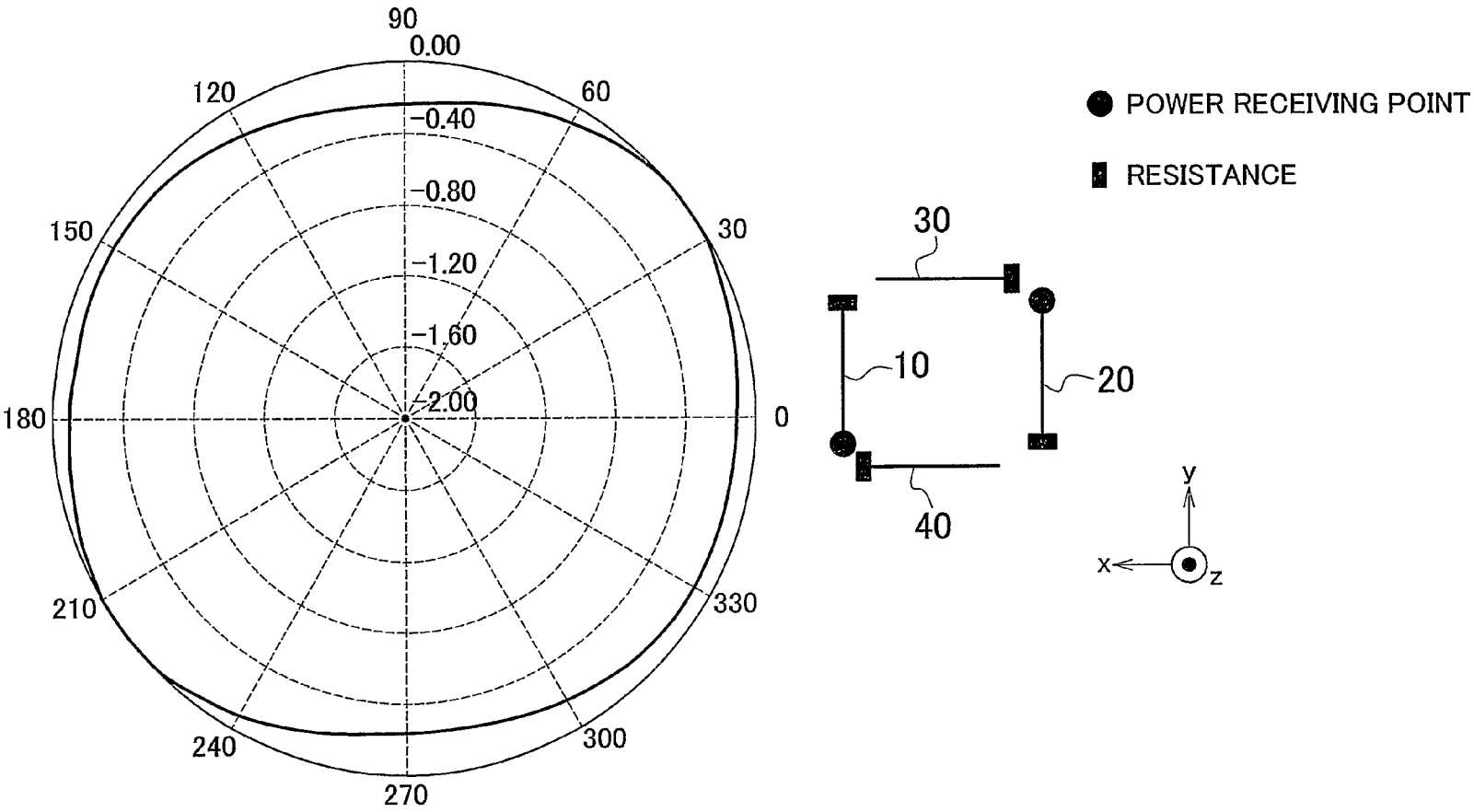
FIG. 6 is a characteristic graph that shows that the antenna device according to the first embodiment may be set to have no directivity.

In addition, FIG. 6 shows the directional characteristic when the wire antennas 10 and 20 arranged in the y direction are used and then the received outputs are combined. In this case, the receiving antenna device has no directivity. In the above embodiment, the receiving antenna device has the wire antennas each having the power receiving point 13. However, a radiation antenna device may be configured so that wire antennas each having a power feeding point 13 are used instead of the power receiving point 13.

Figure 7:
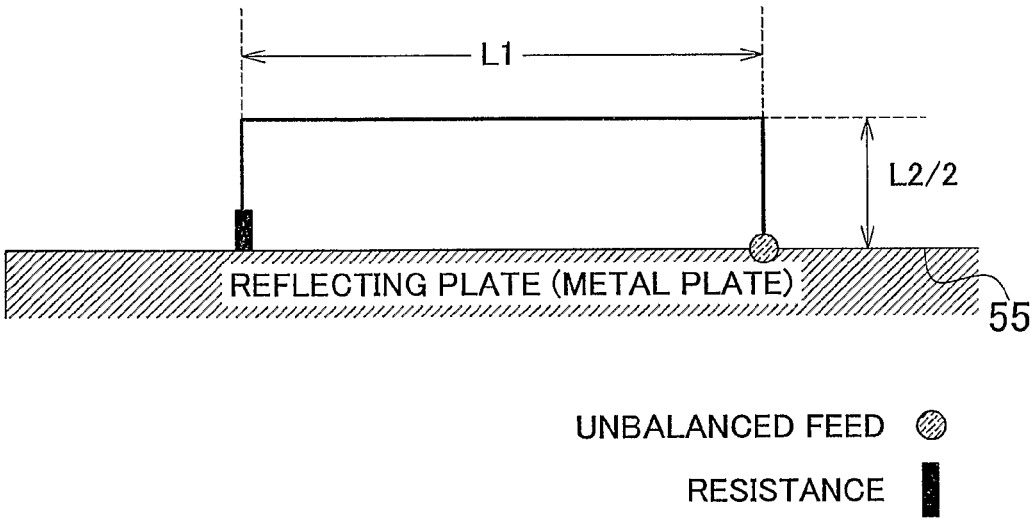
FIG. 7 is a configuration diagram that shows an antenna device of which a second wire line of each of the wire antennas is formed of a metal plate that is shared by the wire antennas.

In the above embodiment, the second wire lines 12, 22, 32 and 42 are respectively parallel to the first wire lines 11, 21, 31 and 41. Instead, as shown in FIG. 7, each of the four second wire lines may be formed of a mirror image that is formed by a metal plate (planar conductor) 55 shared by the wire antennas. In this case, the metal plate 55 also functions as a radio wave reflecting plate, and is able to improve receiving electric power and radiating electric power.

Figure 8:
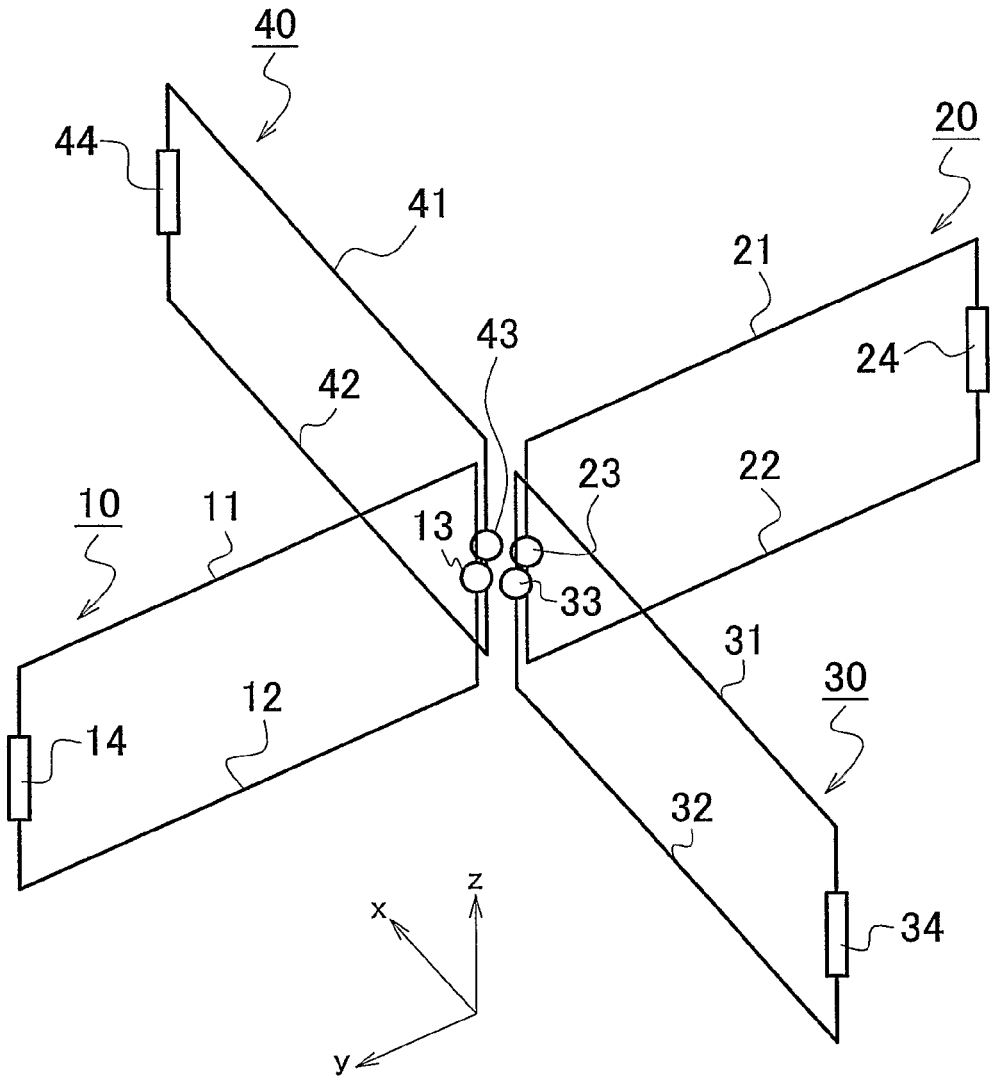
FIG. 8 is a configuration diagram of another antenna device.

As shown in FIG. 8, the wire antennas 10, 20, 30 and 40 may be radially arranged so that the terminal resistances 14, 24, 34 and 44 are placed on the outer side around the power receiving points 13, 23, 33 and 43. The configurations of the first wire lines, second wire lines, power receiving points, terminal resistances, and the like, are similar to those of the first embodiment shown in FIG. 1, and like reference numerals denote the same components. In this case as well, a reflecting plate that reflects radio waves may be provided, and each second wire line may be formed of a metal plate shared by the wire antennas.

Figure 9A:
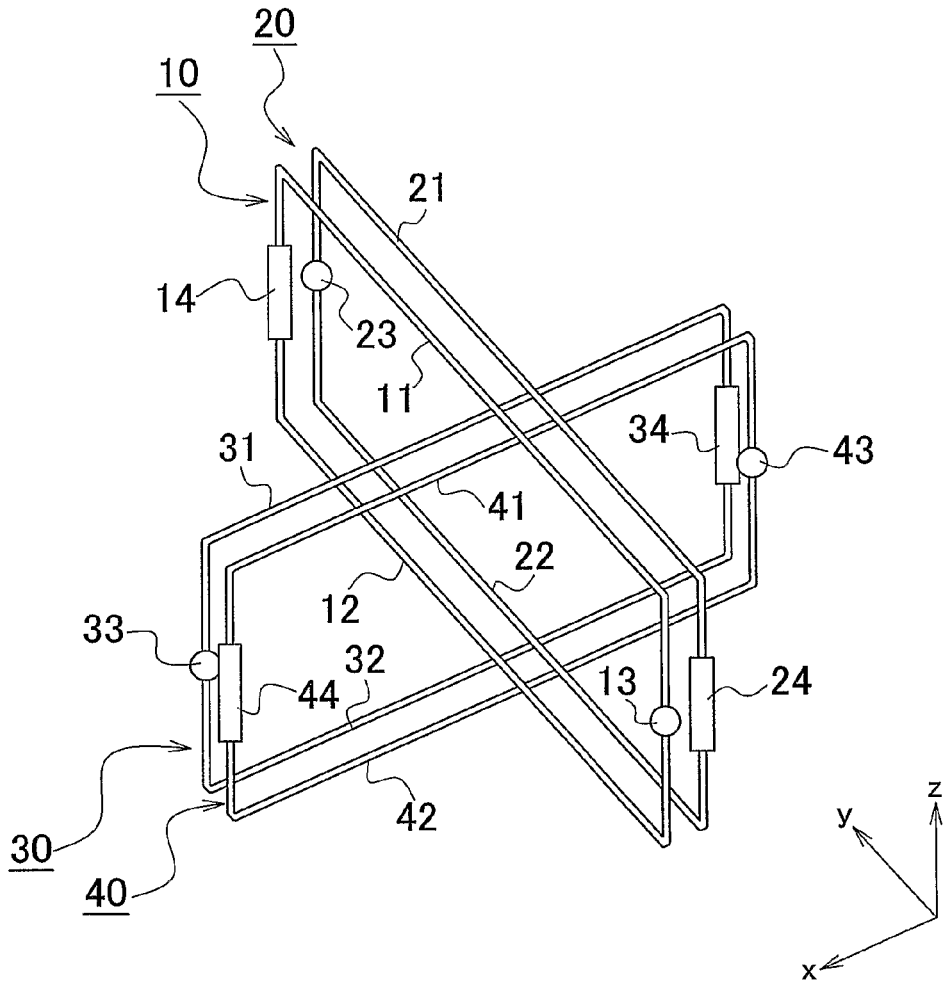
FIG. 9A and FIG. 9B are configuration diagrams of further another antenna device.
Figure 9B:
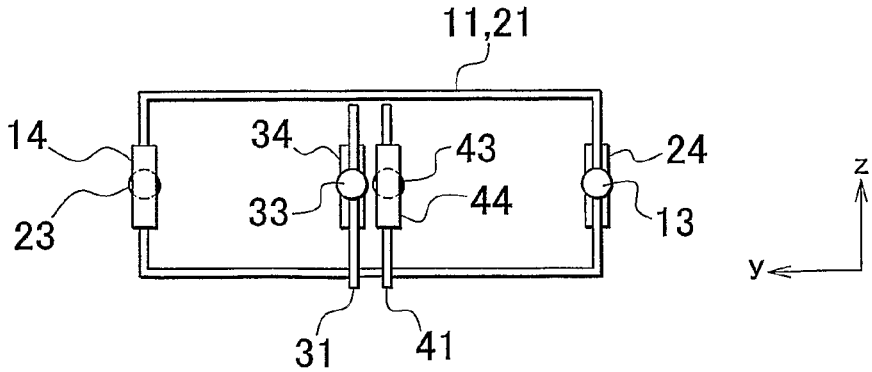

In addition, it is also applicable that, as shown in FIG. 9A and FIG. 9B, the wire antennas 10 and 20 arranged in the y-axis direction are located in proximity to each other while they are electrically insulated, the wire antennas 30 and 40 arranged in the x-axis direction are located in proximity to each other while they are electrically insulated, and then a set of the wire antennas 10 and 20 are arranged perpendicular to a set of the wire antennas 30 and 40. The configurations of the first wire lines, second wire lines, power receiving points, terminal resistances, and the like, are similar to those of the first embodiment shown in FIG. 1, and like reference numerals denote the same components. In this case as well, a reflecting plate that reflects radio waves may be provided. In addition, it is applicable that the first wire lines and a metal plate shared by the wire antennas and provided parallel to the first wire lines constitute the respective antennas and then the second wire lines are formed of mirror images of the first wire lines, formed by the shared metal plate. In addition, it is also applicable that the wire antennas 10 and 20 arranged in the y-axis direction are arranged at an upper side in the z-axis direction and then the wire antennas 30 and 40 arranged in the x-axis direction are arranged at a lower side in the z-axis direction. In this case as well, a reflecting plate that reflects radio waves may be provided, and each second wire line may be formed of a mirror image of the first wire line, formed by the shared metal plate. In the above embodiment, where the wavelength of a radio wave used is $\lambda$, L1 is desirably longer than or equal to $\lambda/10$ and shorter than or equal to $\lambda$. In addition, L1 is desirably longer than or equal to twice as large as L2 and shorter than or equal to three times as large as L2. In addition, D is desirably longer than or equal to $\lambda/20$ and shorter than or equal to $\lambda/10$.

With the configurations according to the above embodiment and alternative embodiments, only a pair of the first wire line and the second wire line (one wire antenna) may be used to constitute an antenna device.

The invention claimed is:

1. An antenna device that radiates or receives a radio wave, comprising:

four wire antennas, wherein each of the wire antennas includes:

a first wire line;

a second wire line that is parallel to the first wire line;

a power feeding/receiving point that is provided at proximal portions of the first wire line and second wire line; and a terminal resistance that is provided at distal end portions of the first wire line and second wire line and at a connecting point between the first wire line and the second wire line, wherein a first antenna set formed of a pair of facing wire antennas is arranged so that orientation vectors of the respective wire antennas directed from the power feeding/receiving points to the terminal resistances are antiparallel to each other, a second antenna set formed of another pair of facing wire antennas is arranged so that the orientation vectors of the respective wire antennas are antiparallel to each other, and the first antenna set and the second antenna set are arranged so that the orientation vector of one of the wire antennas of the first antenna set is not parallel to the orientation vector of one of the wire antennas of the second antenna set.

2. The antenna device according to claim 1, wherein the length of each first wire line is smaller than or equal to a wavelength of a radio wave used and larger than or equal to one-tenth of the wavelength of the radio wave used.

3. The antenna device according to claim 1, wherein the interval between each of the first wire lines and a corresponding one of the second wire lines is smaller than or equal to half of the length of each first wire line and larger than or equal to one-third of the length of each first wire line.

4. The antenna device according to claim 1, wherein an angle made between the orientation vector of one of the wire antennas of the first antenna set and the orientation vector of one of the wire antennas of the second antenna set is larger than or equal to 45 degrees and smaller than or equal to 135 degrees.

5. The antenna device according to claim 1, wherein the four wire antennas are arranged on the same plane.

6. The antenna device according to claim 1, wherein the first antenna set and the second antenna set are arranged on top of each other.

7. The antenna device according to claim 1, wherein the four wire antennas are arranged so as to form any one of a square, a rhombus, a rectangle and a parallelogram.

8. The antenna device according to claim 1, wherein the four wire antennas are radially arranged.

9. The antenna device according to claim 1, wherein each second wire line is a mirror image of the corresponding first wire line, formed by a planar conductor.

10. The antenna device according to claim 1, further comprising:

a reflecting plate that reflects an incoming radio wave.

11. The antenna device according to claim 10, wherein the interval between each second wire line and the reflecting plate is larger than or equal to one-twentieth of a wavelength of a radio wave used and smaller than or equal to one-tenth of the wavelength of the radio wave used.

12. The antenna device according to claim 1, wherein each power feeding/receiving point is a power receiving point which is connected to a coaxial cable via a balun.

13. The antenna device according to claim1, wherein each of the four wire antennas is arranged along each side of a square so that one of the four wire antennas is disposed on a different respective side of the square, and the power feeding/receiving point of a first antenna of the four wire antennas is arranged proximate to the terminal resistance of a second antenna of the wire antennas that is adjacent to the first antenna.

14. The antenna device according to claim 1, wherein each of the four wire antennas is arranged such that each wire antenna extends along the radial direction around a center, and the power feeding/receiving points of the four wire antennas are arranged proximate to the center.

15. The antenna device according to claim 1, wherein a first pair of the four wire antennas comprising a first wire antenna and a second wire antenna, wherein the first wire antenna is stacked on the second wire antenna such that the power feeding/receiving point of the first wire antenna is arranged proximate to the terminal resistance of the second wire antenna, is arranged orthogonal to a second pair of the wire antennas.

* * * * *